US005781841A

United States Patent [19]

Kouroku et al.

[11] Patent Number: 5,781,841

[45] Date of Patent: Jul. 14, 1998

[54] TONER COLLECTOR AND IMAGE FORMING UNIT HAVING TONER COLLECTOR BAG

[75] Inventors: Moriyuki Kouroku, Higashimurayama; Tatsumi Shimanari, Fussa; Takao Yorifuji; Noriki Ono, both of Higashiyamato; Yoshiharu Abe, Tokyo, all of Japan

[73] Assignees: Casio Computer Co., Ltd.; Casio Electronics Manufacturing Co., Ltd., both of Tokyo, Japan

[21] Appl. No.: 837,923

[22] Filed: Apr. 11, 1997

[30] Foreign Application Priority Data

Apr. 11, 1996 [JP] Japan ..... 8-092500

[51] Int. Cl.[6] ..... G03G 00/00

[52] U.S. Cl. ..... 399/360; 399/35; 399/358

[58] Field of Search ..... 399/360, 358, 399/35, 98

[56] References Cited

U.S. PATENT DOCUMENTS

| | | | |
|---|---|---|---|
| 4,660,960 | 4/1987 | Fukunaga et al. | 399/258 |
| 4,982,230 | 1/1991 | Ogura et al. | 399/35 |
| 5,383,578 | 1/1995 | Nishimura | 399/258 |

FOREIGN PATENT DOCUMENTS

| | | |
|---|---|---|
| 63-10424 | 3/1988 | Japan . |
| 5-289583 | 11/1993 | Japan . |
| 6-222668 | 8/1994 | Japan . |

*Primary Examiner*—Arthur T. Grimley
*Assistant Examiner*—Quana Grainger
*Attorney, Agent, or Firm*—Frishauf, Holtz, Goodman, Langer & Chick

[57] ABSTRACT

A toner collector includes a tube having at least one opening in an intermediate portion between both end portions, one of the both end portions being closed, a toner collecting bag covering the tube, and connected to the tube at the both end portions of the tube, and a waste toner transfer member, connected to the other of the both end portions of the tube, for transferring toner to the other of the both end portions from an outer side of the tube. An image forming unit, which is combined with an image carrier on which an image to be developed by toner is formed, and a cleaner for removing unnecessary toner from the image carrier to make an image forming apparatus so that the image on the image carrier is developed by toner, includes a developing unit for developing the image on the image carrier by toner, a toner hopper having a toner containing space, for supplying toner to the developing unit, a tube provided in the toner containing space of the toner hopper, having at least one opening in an intermediate area between the both end portions, one of the both end portions being closed, a toner collecting bag covering the tube and connected to the tube at the both end portions of the tube, and a waste toner transfer member, connected to the other of the both end portions, for transferring unnecessary toner to the other of the both end portions of the tube from the cleaner.

16 Claims, 11 Drawing Sheets

TONER COLLECTOR AND IMAGE FORMING UNIT HAVING TONER COLLECTOR BAG

BACKGROUND OF THE INVENTION

This invention relates to a toner collector for collecting unnecessary toner removed from an image carrier on which an image to be developed by toner is formed, and an image forming unit having the toner collector.

In a conventional printer or a copying machine structured as an image forming apparatus of an electro-photographic type, while a photosensitive drum (i.e., being an image carrier on which an image to be developed by toner is formed) is rotated at one time, an outer peripheral surface of the photosensitive drum is uniformly charged by a charger, an electrostatic latent image is formed on the outer peripheral surface of the photosensitive drum by an exposure device, the electrostatic latent image is developed by a developing device using toner, the developed toner image is transferred onto paper serving as a recording medium, from the photosensitive drum, and unnecessary toner left on the photosensitive drum is removed from the photosensitive drum by a cleaner.

Unnecessary toner is stored in the cleaner or in a waste toner bottle which is detachably attached to the cleaner. Or, unnecessary toner is returned to the developing device to be reused.

If the cleaner is structured to store unnecessary toner in the cleaner, the outer size of the cleaner is increased, and that of the image forming apparatus is also increased. In the case that the waste toner bottle storing unnecessary toner is used, replacement of the waste toner bottle is troublesome. Also, waste toner tends to leak out from the waste toner bottle during the replacement, and the surroundings of the waste toner bottle are easily dirtied. In the case that the unnecessary toner is returned to the developing device to be reused, moreover, a color mixing occurs in an image forming apparatus which uses a plurality of color toners.

In a recent relatively small-sized image forming apparatus, to make maintenance easy, image forming elements, such as a photosensitive drum, a cleaner, a charger, and a developing device are combined to form an image forming unit which is detachable from a main body housing of the image forming apparatus. Or, a photosensitive drum, a cleaner, and a charger are combined to form a photosensitive drum unit as a first image forming unit, and a developing device which is different from the photosensitive drum unit in life time (i.e., usage span, forms a developing unit as a second image forming unit. The image forming apparatus having one image forming unit as described above is superior in its operability, and the image forming apparatus having two image forming units as described above is superior in that the photosensitive drum unit and the developing unit, which are different in their life time, can be managed independently from each other. Then, in such an image forming apparatus, the miniaturization and the extension of the life are required at the same time.

In order to satisfy such a requirement, Japanese Patent Application KOKOKU Publication No. 63-10424 discloses that a free space produced in a developer hopper of the developing device may be used as a waste toner collecting space. The free space is produced in accordance with the use of toner in a toner containing space of the developer hopper. FIGS. 10A and 10B are longitudinal cross-sectional views showing the pre-use state of the toner collector and the post-use state of the toner collector, respectively, which are shown in Japanese Patent Application KOKOKU Publication No. 63-10424.

As shown in FIG. 10A, in the conventional toner collector, an upper portion of the toner containing space of the developer hopper 1 of the developing device is partitioned by an elastic partitioning film 5. In the toner containing space, unused toner 4 and a developing roller 2 are contained under the partitioning film 5, and the developing roller 2 comes in contact with an outer peripheral surface of a photosensitive drum (not shown) to develop an electrostatic latent image on the outer peripheral surface by toner 4. An upper portion of the toner containing space located above the partitioning film 5 forms a waste toner containing space 3 for collecting waste toner. The waste toner containing space 3 is communicated with a cleaner (not shown) by a waste toner transfer member (not shown) which is connected to a through hole 6 formed on the upper portion of the peripheral wall of the developer hopper 1.

When unused toner 4 contained under the partitioning film 5 in the toner containing space of the developer hopper 1 is applied on the photosensitive drum (not shown) by the developing roller 2 and the amount of unused toner 4 is reduced, the amount of unnecessary toner (waste toner) which is collected from the photosensitive drum (not shown) by the cleaner (not shown), is increased. Unnecessary toner 4' is transferred to the waste toner containing space 3 from the cleaner (not shown) by the waste toner transfer member (not shown), and is deposited on the partitioning film 5 in the waste toner containing space 3 to make the partitioning film 5 hang down, as shown in FIG. 10B.

Since unused toner 4 tends to absorb moisture, and is easily solidified, it is preferable that a toner mixer 7 is provided above the developing roller 2 in the toner collecting space of the developer hopper 1, as shown in FIG. 11. In the case where the toner mixer 7 is provided, the partitioning film 5 must be prevented from contacting the toner mixer 7 so that rotation of the toner mixer 7 is not obstructed when the partitioning film 5 is hung down by the deposition of unnecessary toner 4' on the partitioning film 5.

However, the partitioning film 5, which is provided to cross the upper portion of the toner containing space of the developer hopper 1, is nevertheless largely hung down. Moreover, it is troublesome to provide the partitioning film 5 in the toner containing space so as to cross the upper portion of the toner containing space.

BRIEF SUMMARY OF THE INVENTION

This invention is derived from the above described circumstances, and an object of this invention is to provide a toner collector which can be easily attached to an image forming unit, and an image forming unit using the toner collector.

In order to achieve the above object, there is provided a toner collector comprising:

- a tube having at least one opening in an intermediate portion between both end portions thereof, one of the both end portions being closed;
- a toner collecting bag covering the tube, and connected to the tube at the both end portions of the tube; and
- a waste toner transfer member, connected to the other of the both end portions of the tube, for transferring toner to the other of the both end portions from an outer side of the tube.

In this case, since the toner collecting bag and the tube are combined with each other, the toner collecting bag can be easily attached to a device using the toner collector. Moreover, an amount of hanging of the toner collecting bag produced by unnecessary toner deposited thereon is small. Therefore, it is possible to collect a large amount of unnecessary toner.

The above-structured toner collector can be combined with an image forming apparatus having an image carrier on which an image developed by toner is formed. In this case, toner which is collected to the toner collecting bag, is waste toner which is removed from the image carrier of the image forming apparatus.

According to the above-structured toner collector, it is preferable that the toner collecting bag is shaped like substantially a T-shirt whose neck and hem portions are closed, the tube is inserted into the toner collecting bag through openings of a pair of portions of the toner collecting bag corresponding to both sleeve portions of the T-shirt, and the paired portions of the toner collecting bag are closely fixed to the both end portions of the tube.

The above-structured toner collecting bag can be manufactured easy without a complicated manufacturing process such as folding, and the manufacturing cost is low.

In the case where the toner collecting bag is shaped like substantially a T-shirt, it is preferable that an outer peripheral surface of each of the both end portions of the tube has a rugged portion, and the toner collecting bag has a pair of winding portions at the paired portions of the toner collecting bag corresponding to both sleeve portions of the T-shirt, the paired portions of the bag being closely fixed to the rugged portions of the both end portions of the tube by winding the winding portions on the paired portions of the toner collecting bag.

By the combination of the rugged portions of the outer peripheral surfaces of the both end portions of the tube and the winding portions provided on the paired portions of the toner collecting bag corresponding to the both sleeve portions of the T-shirt, the connection of the toner collecting bag to the both end portions of the tube is strengthened. Also, the closely fixing of the toner collecting bag to the both end portions of the tube is strengthened.

According to the above-structured toner collector, the toner collecting bag can be formed of synthetic resin.

According to the above-structured toner collector, it is preferable that a length of the toner collecting bag along a longitudinal direction of the tube is longer than a distance between the both end portions of the tube, and that the toner collecting bag is compressed in a direction along the longitudinal direction and then connected to the both end portions of the tube.

By connecting the toner collecting bag to the both end portions of the tube in the above described way, the toner collecting bag can be expanded to space areas corresponding to the both end portions of the tube beyond a space area between the both end portions of the tube. Therefore, a toner collecting capacity of the toner collecting bag can be used to its maximum extent.

According to the above-structured toner collector, the waste toner transfer member can include a toner transfer pipe extending from the outer side of the tube to the other of the both end potions of the tube and connected to the other of the both end portions of the tube, and a transfer screw extending from an interior of the toner transfer pipe to an interior of the tube and rotated in the interior of the toner transfer pipe and the interior of the tube.

The structure of the above-mentioned waste toner transfer member is simple, and the manufacture thereof is easy.

Moreover, in order to achieve the above-mentioned object, an image forming unit, which is combined with an image carrier on which an image to be developed by toner is formed, and a cleaner for removing unnecessary toner from the image carrier to make an image forming apparatus so that the image on the image carrier is developed by toner, comprising:

developing means for developing the image on the image carrier by toner;

a toner hopper, having a toner containing space, for supplying toner to the developing means;

a tube provided in the toner containing space of the toner hopper, having at least one opening in an intermediate area between both end portions thereof, one of the both end portions being closed;

a toner collecting bag covering the tube and connected to the tube at the both end portions of the tube; and a waste toner transfer member, connected to the other of the both end portions, for transferring unnecessary toner to the other of the both end portions of the tube from the cleaner.

According to the above-structured image forming unit, the tube, the toner collecting bag, and the waste toner transfer member can be structured in a manner similar to the other above described embodimentes of the toner collector of this invention.

According to the above-structured image forming unit, the toner hopper can include a pair of long opposite wall portions, a pair of short opposite wall portions, and a toner collecting bag support member; the long opposite wall portions extending in parallel to each other and being spaced from each other in a direction perpendicular to the extending direction of the long opposite wall portions; the short opposite wall portions being connected to both ends of the long opposite wall portions, being spaced from each other in the extending direction, and defining the toner containing space in cooperation with the long opposite wall portions; and the toner collecting bag support member being connected to the long opposite wall portions under the tube and the toner collecting bag, and supporting the hanging of the toner collecting bag produced by the weight of the collected toner so as to define an amount of the hanging.

The toner collecting bag support member defines the amount of the hanging of the toner collecting bag, so that the height of the toner hopper is reduced.

According to the above-structured image forming unit, the toner hopper can include a toner mixing member under the toner collecting bag support member in the toner containing space. The toner mixing member is useful to prevent toner from solidifying in the toner hopper. Further, the toner collecting bag support member defining the amount of the hanging of the toner collecting bag, prevents the hung toner collecting bag from contacting the toner mixing member so that operation of the toner mixing member and that of the image forming apparatus using the image forming unit are not obstructed.

According to the above-structured image forming unit, in the case where the toner hopper includes the toner collecting bag support member, it is preferable that the toner collecting bag support member functions as a reinforcing member for the toner hopper. Such a toner collecting bag support member as described above can improve the rigidity of the toner hopper, and that of the image forming unit. This can facilitate the thinning of the toner hopper, and the miniaturization and the weight-reduction of the image forming unit. Moreover, the toner hopper and the image forming unit can be enlarged.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

The following will specifically explain various kinds of embodiments of this invention with reference to the accompanying drawings.

Figure 1:
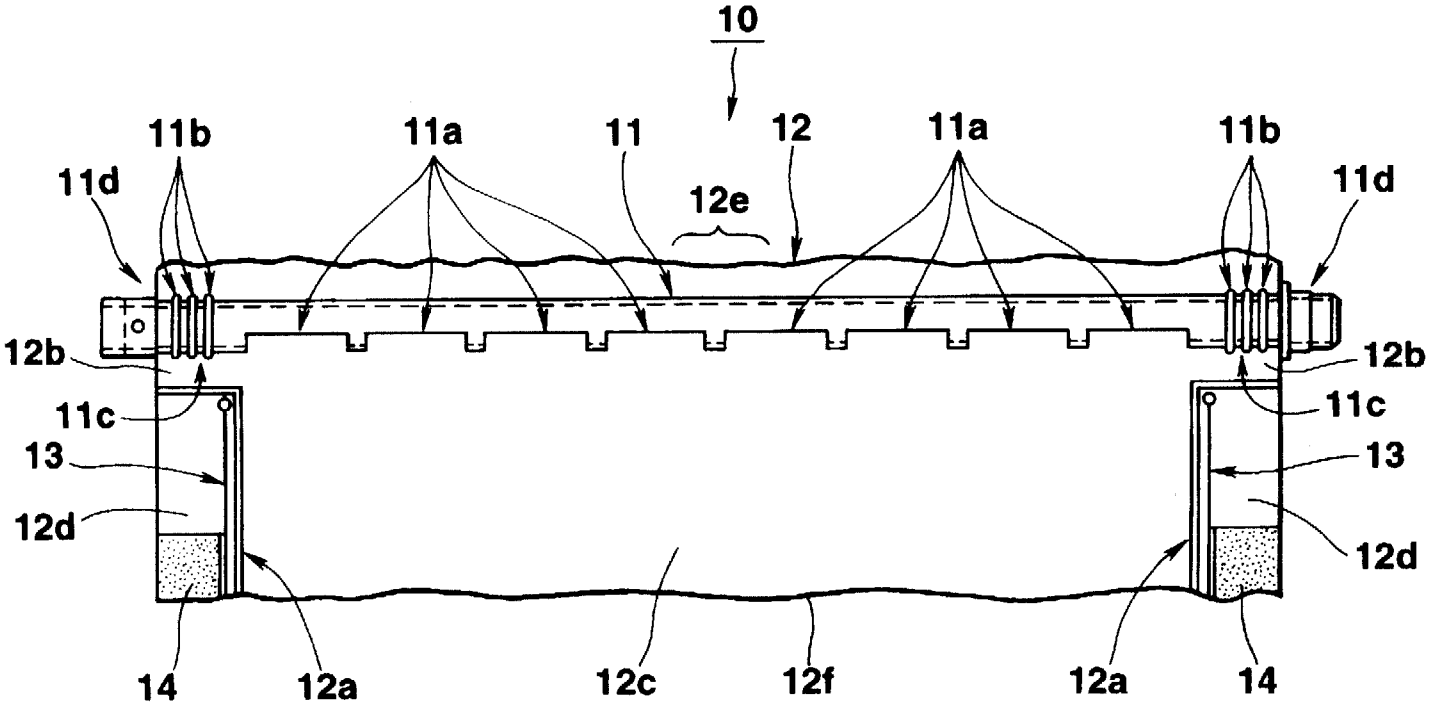
FIG. 1 is a front view showing a toner collector according to one embodiment of this invention, in one step of its assembly process.

FIG. 1 is a front view showing a toner collector according to one embodiment of this invention, in one step of its assembly process. FIGS. 2A, 2B, 2C and 2D are front and perspective views each showing a plurality of steps of the assembly process of a toner collector of FIG. 1, and the step of FIG. 2B corresponds to the step shown in FIG. 1.

As shown in FIG. 1, a toner collector 10 according to one embodiment of this invention comprises a cylindrical tube 11 and a waste toner collecting bag 12. The cylindrical tube 11 has a plurality of openings 11*a*, which are formed in a middle area between both end portions 11*d* to be oriented to a predetermined direction. Three lines of ribs 11*b* are formed at each of the both end portions 11*d*. The ribs 11*b* are spaced from one another in a longitudinal direction of the cylindrical tube 11, and the three lines of ribs 11*b* extend in a circumferential direction of the cylindrical tube. The ribs 11*b* form a rugged portion 11*c* at each of the both end portions 11*d* of the cylindrical tube 11.

The waste toner collecting bag 12 is made of soft material of synthetic resin such as polyethylene. The size of the waste toner collecting bag 12 in the longitudinal direction of the cylindrical tube 11 before the waste toner collecting bag 12 is attached to the cylindrical tube 11, may be set to be at least equal to a distance between outer ends of the rugged portions 11*c* of the both end portions 11*d*. However, it is preferable that the size of the waste toner collecting bag 12 is set to be longer than the distance between the outer ends of the rugged portions 11*c* of the cylindrical tube 11.

The waste toner collecting bag 12 is structured as follows.

At first, an elongate flattened tubular film is cut to a predetermined length. Both cut end portions are welded by, for example, a hot iron or an electronic sewing machine, etc., as if lower edges of both sleeves 12*b* of a T-shirt and both sides of a body portion 12*c* of the T-shirt were edged. Moreover, two slits 13 are formed at the outsides of two width-direction extending welded lines 12*a* corresponding to both sides of the body portion 12*c* of the T-shirt. The slits 13 extend along the welded lines 12*a* from positions close to two longitudinal direction extending welded lines corresponding to the lower edges of the both sleeves 12*b* of the T-shirt, to one longitudinal direction extending edge of the waste toner collecting bag 12.

That is, the waste toner collecting bag 12 has an outer shape like a T-shirt whose length is short and width is extremely large, but two longitudinal direction extending edges correspond to a neck of the T-shirt and a hem of the T-shirt, are closed. Then, at each of the both cut end portions, only a distance corresponding to each of the both ends of the sleeves 12*b* of the T-shirt is opened. Moreover, the waste toner collecting bag 12 has a pair of hanging portions 12*d* which extend downward from the lower edges of the both sleeves 12*b* of the T-shirt and are separated from the body portion 12*c* of the T-shirt by the slits 13. An adhesive tape 14 is fixed onto a lower end portion (free end portion) of each hanging portion 12*d* such that an adhesive surface is directed outward.

Then, the both sleeves 12*b* of the waste toner collecting bag 12 and the hanging portions 12*d* form a fixing portion of the waste toner collecting bag 12 to both end portions 11*d* of the cylindrical tube 11.

Figure 2A:
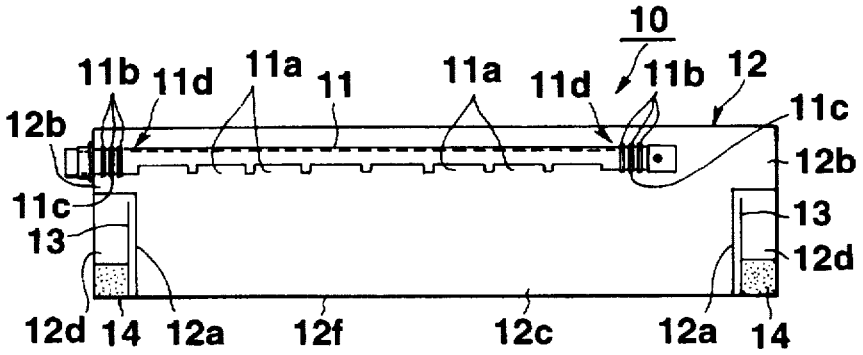
FIGS. 2A, 2B, 2C and 2D are front and perspective views each showing a plurality of steps of the assembly process of the toner collector of FIG. 1, and the step of FIG. 2B corresponds to the step shown in FIG. 1.
Figure 2B:
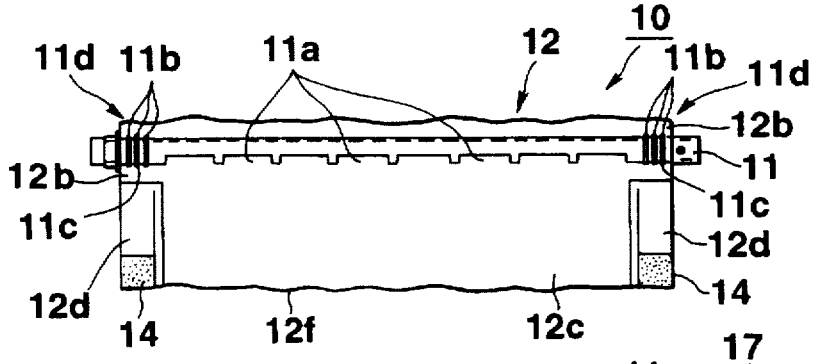

The above-structured waste toner collecting bag 12 is attached to the cylindrical tube 11 as follows:

First, as shown in FIG. 2A, the openings 11*a* of the cylindrical tube 11 are directed downward, and the cylindrical tube 11 is inserted from the opening of one sleeve 12*b* to that of the other sleeve 12*b*. Next, as shown in FIG. 2B, the upper end portion of the bag 12 between the both sleeves 12*b* is compressed to make the both sleeves 12*b* correspond to the rugged portions 11*c* of the both end portions 11*d* of the cylindrical tube 11. Finally, two hanging portions 12*d* are wound around the rugged portions 11*c* to serve as winding portions. Thereafter, the windings of the hanging portions 12*d* are fixed by the adhesive tapes 14 of the lower end portions (free end portions) of the hanging portions 12*d*.

Figure 2C:
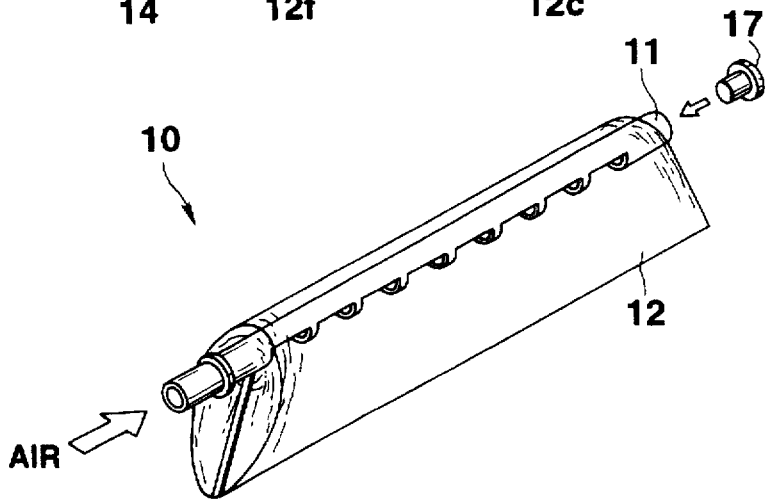

The cylindrical tube 11 with the waste toner collecting bag 12 is attached to a predetermined position of a developing toner containing housing of an image forming unit using toner, and forms the toner collector 10. Before the cylindrical tube 11 with the waste toner collecting bag 12 is attached to the predetermined position of the developing toner containing housing, one of both end openings of the cylindrical tube 11 is temporarily closed by a cover 17, and air is blown into the other end opening of the cylindrical tube 11 so that the waste toner collecting bag 12 is expanded as shown in FIG. 2C. The reason why the waste toner collecting bag 12 is expanded is to check breakage, or a hole in the waste toner collecting bag 12 to cause leakage of toner from the bag 12, and to shape the waste toner collecting bag 12 to make the bag 12 have a maximum capacity after the cylindrical tube 11 with the waste toner collecting bag 12 is attached to the predetermined position of the developing toner containing housing.

Figure 2D:
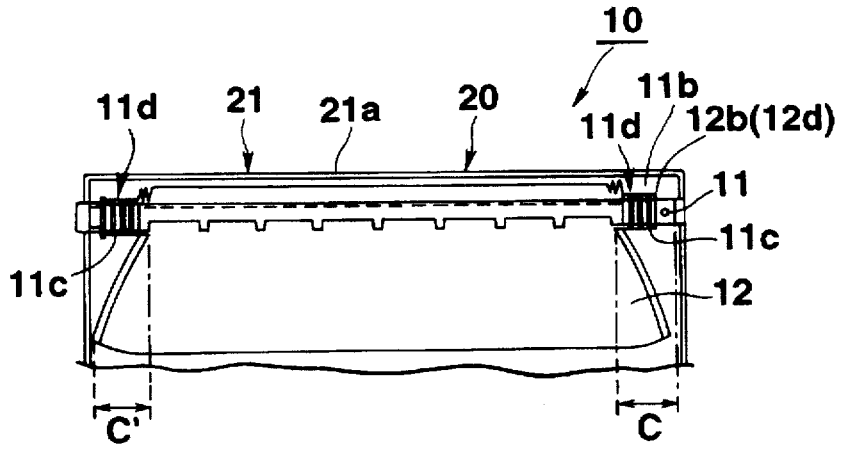

FIG. 2D shows a state in which the cylindrical tube 11 with the waste toner collecting bag 12 is attached to a predetermined position of an upper end portion of a developing toner containing housing 21*a* of a developing device sub-unit 21 of an image forming unit 20 using toner. As is obvious from FIG. 2D, while the bag 12 expands in the developing toner containing housing 21*a* (FIG. 2B), both side areas of the body portion 12*c* of the waste toner collecting bag 12 are projected under the both end portions 11*b* of the cylindrical tube 11 by amounts of C and C' to enable the waste toner collecting bag 12 to be used to its maximum capacity.

Figure 3:
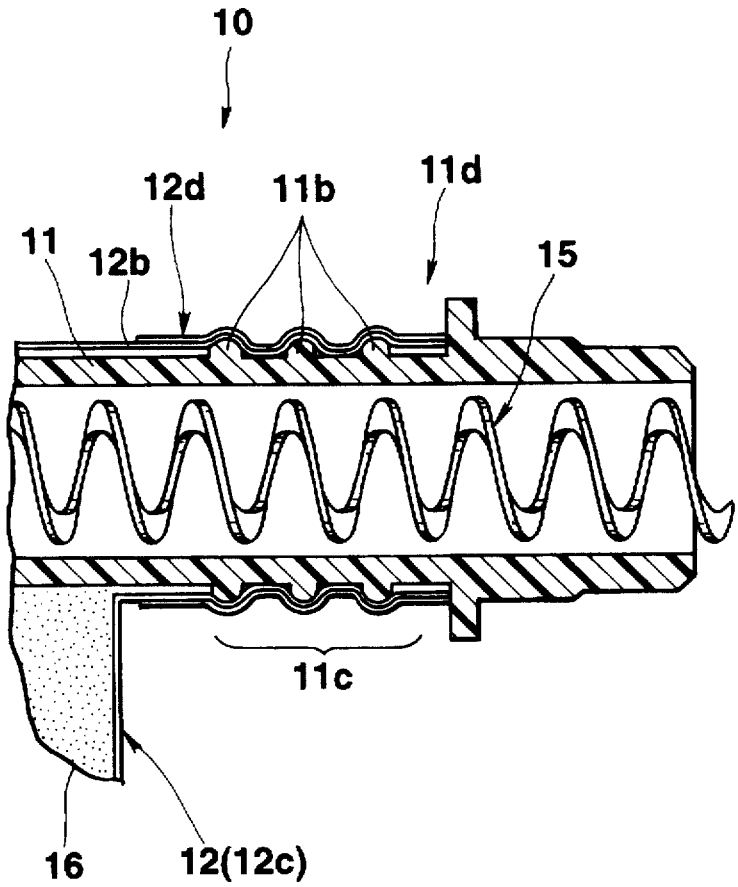
FIG. 3 is an enlarged vertical cross-sectional view showing a state in which one of both sleeve portions of a toner collecting bag is closely fixed on three lines of ribs of a rugged portion of one of both end portions of a tube of a toner collector of FIG. 1 by winding a winding portion of one of the both sleeve portions thereon at the rugged portion, in this figure, a transfer screw which is a part of a waste toner transfer member, is also shown.

FIG. 3 is an enlarged longitudinal cross-sectional view showing a state in which the hanging portion 12*d* corresponding to one of the both sleeves 12*b* of the toner collecting bag 12, is wound around three lines of ribs 11 of the rugged portion 11*c* of one of the both end portions 11*d* of the cylindrical tube 11 of the toner collector of FIG. 1, and the one of the both sleeves 12*b* of the bag 12 is closely fixed on the rugged portion 11*c* of one of the both end portions 11*d*. In this figure, a waste toner transfer screw 15 which functions as a part of a waste toner transfer member, is also shown.

As is obvious from FIG. 3, a free end portion of the waste toner transfer screw 15 is inserted to one end of a central hole of the cylindrical tube 11 with the waste toner collecting bag 12 while the cylindrical tube 11 and the bag 12 are attached to the predetermined position of the upper end portion of the developing toner containing housing 21*a* of the image forming unit 20. The waste toner transfer screw 15 functions as a part of the waste toner transfer member for transferring waste toner from the cleaner (not shown) to the waste toner collecting bag 12 in the image forming unit 20 (FIG. 2D).

Figure 4:
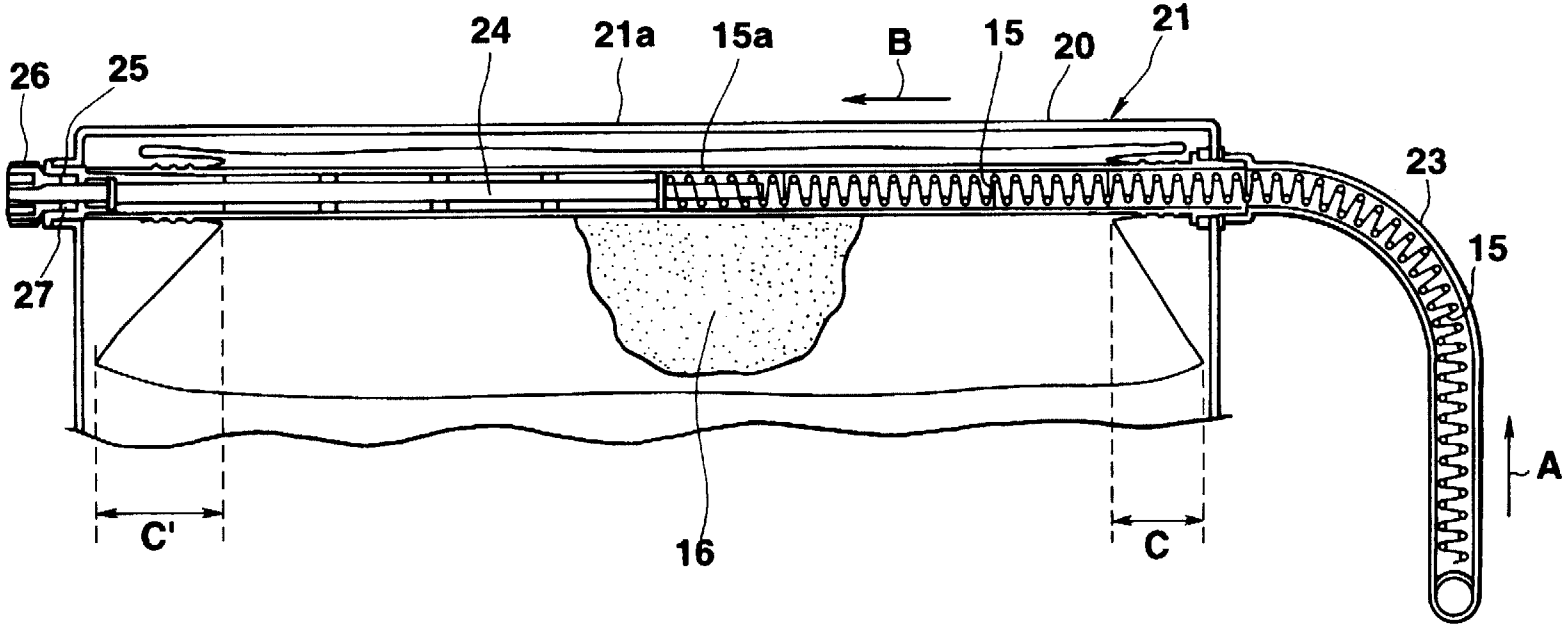
FIG. 4 is a vertical cross-sectional view showing an upper portion of a developing toner containing housing of the image forming unit according to one embodiment of this invention, to the developing toner containing housing the tube with the waste toner collecting bag being attached at a predetermined position together with the transfer screw and a waste toner transferring pipe which forms a part of the transfer member.

FIG. 4 is a longitudinal cross-sectional view showing an upper end portion of the developing toner containing housing 21*a* of the image forming unit 20 according to one embodiment of the present invention, and in this figure, the cylindrical tube 11 with the waste toner collecting bag 12 is attached to a predetermined position together with the waste toner transfer screw 15 and a waste toner transfer pipe 23 which cooperates with the transfer screw 15 to form the waste toner transfer member.

FIG. 4 shows that, while the cylindrical tube 11 with the waste toner collecting bag 12 is attached to the predetermined position of the upper end portion of the developing toner containing housing 21*a*, a tip end 15*a* of the free end portion of the waste toner transfer screw 15 reaches substantially a center of the longitudinal direction of the cylindrical tube 11 in the central hole thereof.

The waste toner transfer screw 15 is stored in the waste toner transfer pipe 23 from its free end portion to a base end portion (not shown). A transfer screw drive shaft 24 is inserted to the central hole of the cylindrical tube 11 from the other opening of the central hole while the cylindrical tube 11 with the bag 12 is attached to the predetermined position of the upper end portion of the developing toner containing housing 21*a*. An inner end of the transfer screw drive shaft 24 is engaged with the tip end 15*a* of the free end portion of the waste toner transfer screw 15.

The transfer screw drive shaft 24 is rotatably supported by a bearing 25 at the other opening of the cylindrical tube 11, and an input gear 26 is fixed to a portion of the transfer screw drive shaft 24 which projects outward from the other opening. The input gear 26 receives driving force for rotating the transfer screw drive shaft 24. Moreover, a packing 27 is inserted to the other opening of the central hole of the cylindrical tube 11 to prevent waste toner from leaking out through the bearing 25.

The waste toner transfer screw 15 which is rotated by the transfer screw drive shaft 24, transfers waste toner as shown by an arrow A from the cleaner (not shown) through the waste toner transfer pipe 23 to the one opening of the central hole of the cylindrical tube 11. Then, in the central hole of the cylindrical tube 11, the waste toner transfer screw 15 transfers waste toner as shown by an arrow B from the one opening to substantially the center of the longitudinal direction of the cylindrical tube 11. As a result, waste toner 16 which is discharged from the large number of openings 11*a* of the cylindrical tube 11 to the waste toner collecting bag 12, is deposited from a portion below the one opening of the central hole of the cylindrical tube 11 to a portion below substantially the center of the longitudinal direction of the cylindrical tube 11. Then, as the amount of the deposition of waste toner 16 is increased, the deposition of waste toner 16 is deployed to a portion below the other opening of the central hole of the cylindrical tube 11.

Figure 5A:
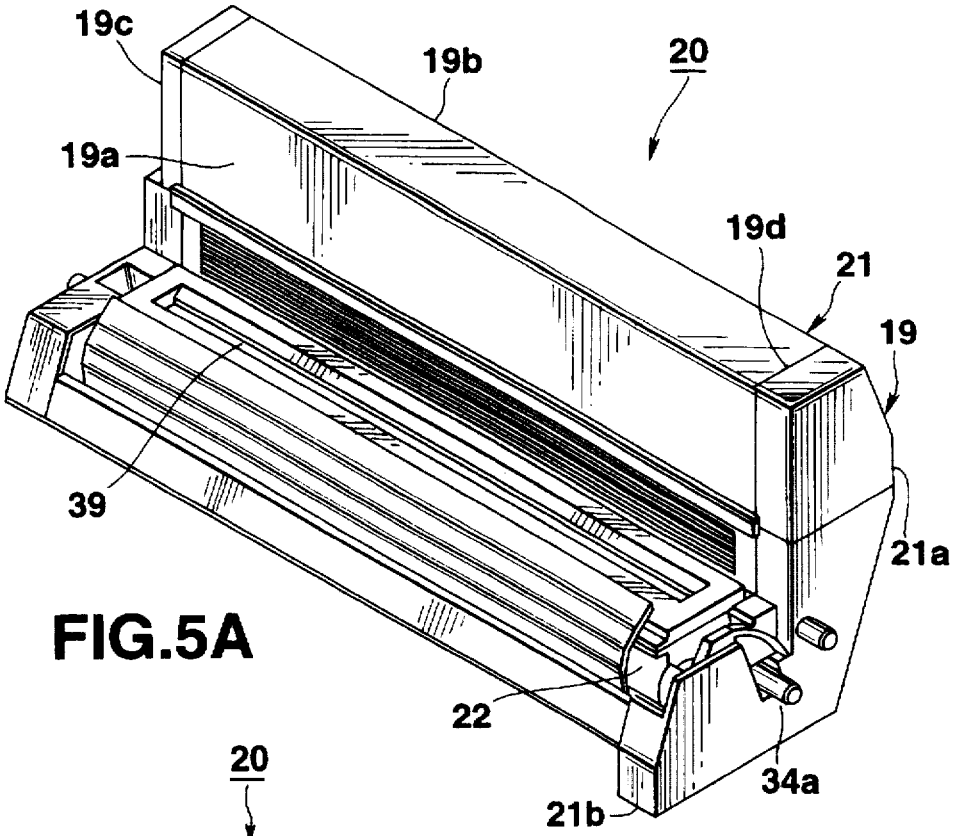
FIG. 5A is a perspective view showing an appearance of the image forming unit according to one embodiment of this invention, the upper end portion of the developing toner containing housing of the image forming unit being shown in the vertical cross-section of FIG. 4.
Figure 5B:
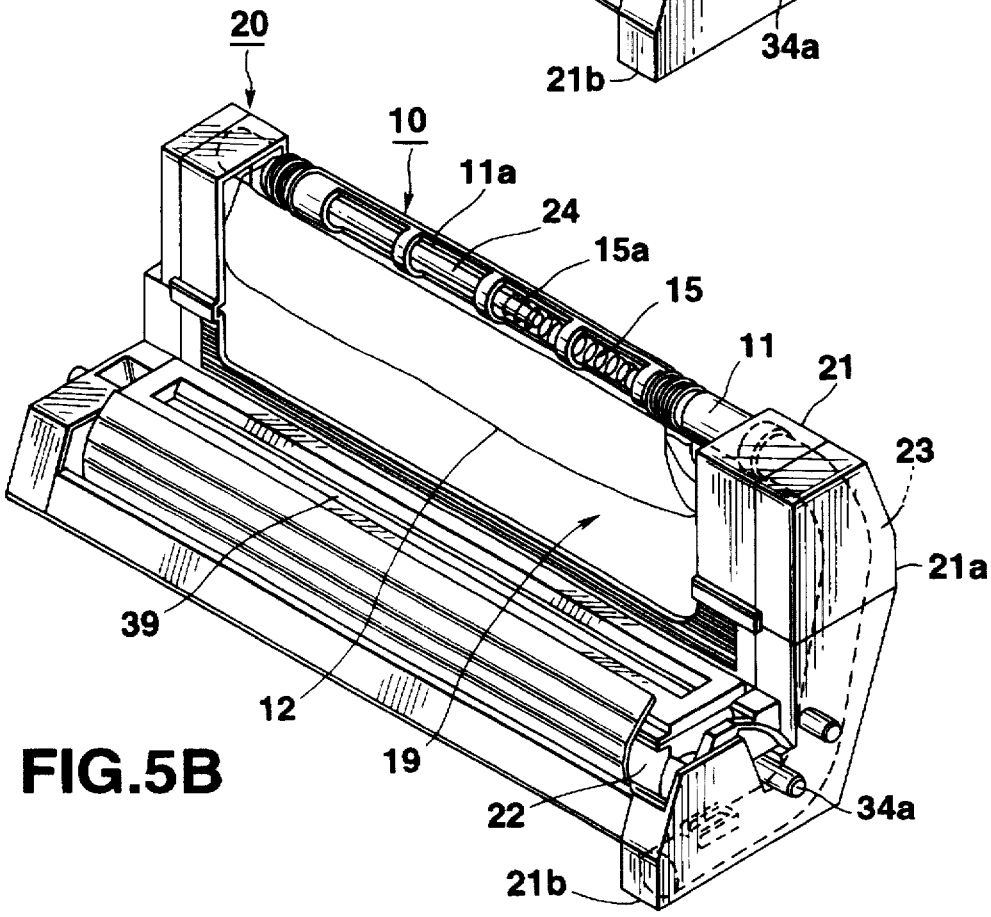
FIG. 5B is a perspective view of the image forming unit according to one embodiment of this invention, a part of which is cut away.
Figure 6:
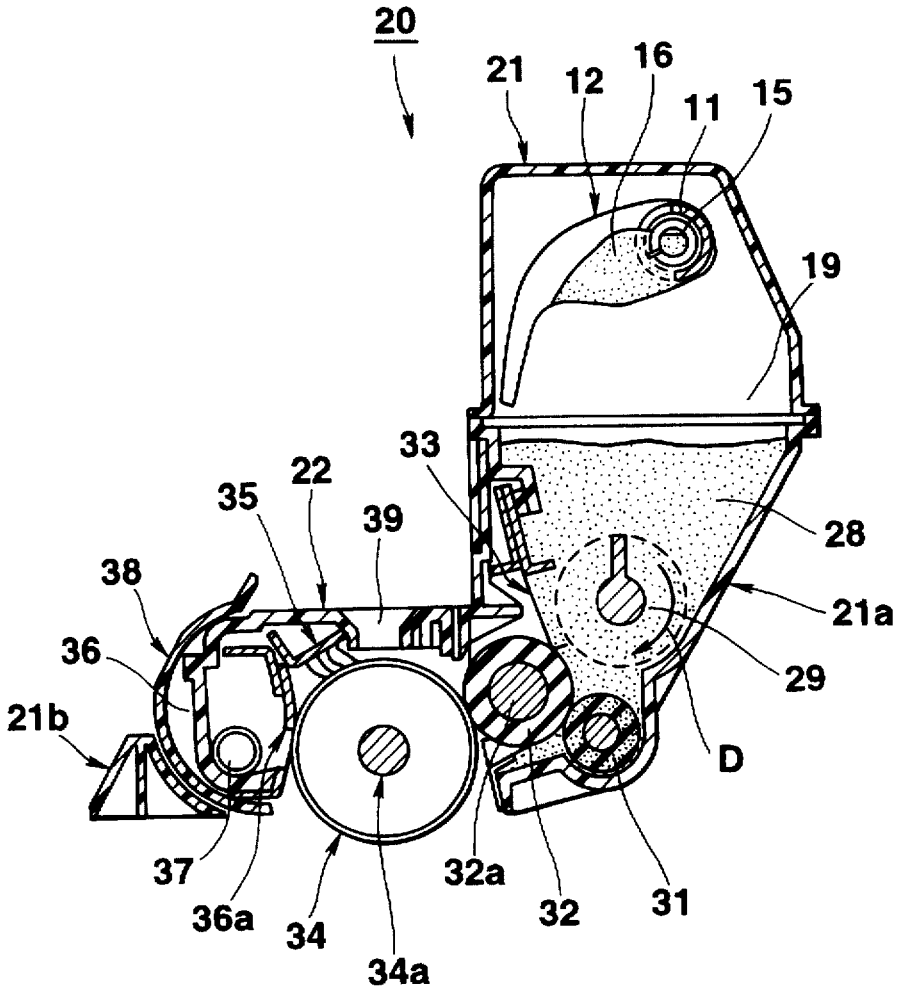
FIG. 6 is a cross-sectional view of the imaging forming unit of FIG. 5A.

FIG. 5A is a perspective view showing an appearance of the image forming unit 20 according to one embodiment of the present invention, the upper end portion of the developing toner containing housing 21*a* of the image forming unit 20 being shown in the longitudinal cross-section of FIG. 4. FIG. 5B is a perspective view of the image forming unit 20, a part of which is cut away. FIG. 6 is a cross-sectional view of the imaging forming unit 20 of FIG. 5A.

As shown in FIGS. 5A and 6, the image forming unit 20 is structured by detachably combining a developing sub-unit 21 with a photosensitive drum sub-unit 22. The developing sub-unit 21 includes the developing toner containing housing 21*a* and a pair of support arms 21*b*. The developing toner containing housing 21*a* defines a developer hopper 19 containing toner 19 functioning as developer in this embodiment. The support arms 21*b* project to one side of the developing toner containing housing 21*a* from both longitudinal end portions of the developing toner containing housing 21*a*. The photosensitive drum sub-unit 22 is detachably supported between the support arms 21*b* of the developing sub-unit 21 by a detachable supporting mechanism (not shown).

The photosensitive drum sub-unit 22 includes a photosensitive drum 34 having a central shaft 34*a* which is rotatably supported by the support arms 21*b* of the developing sub-unit 21. The developer hopper 19 has a toner containing space which is surrounded by a pair of long opposite walls 19*a* and 19*b* and a pair of short opposite walls 19*c* and 19*d*. The long opposite walls 19*a* and 19*b* extend in the longitudinal direction of the photosensitive drum 34 to be parallel to each other, and separate from each other in a radial direction of the photosensitive drum 34. The short opposite walls 19*c* and 19*d* are connected to both ends of the long opposite walls 19*a* and 19*b*, and separate from each other in the longitudinal direction. The cylindrical tube 11 with the waste toner collecting bag 12 are supported at its both end portions 11*d* by the upper end portions of the short opposite walls 19*c* and 19*d* of the developer hopper 19 of the developing toner containing housing 21*a*, and the waste toner collecting bag 12 is hung down in the toner containing space of the developer hopper 19 between the both end portions 11*d* of the cylindrical tube 11.

As specifically shown in FIG. 6, at the lower end portion of the toner containing space of the developer hopper 19 of the developing toner containing housing 21*a*, a developing roller 32 and a toner supply roller 31 are provided. The developing roller 32 extends to be parallel to the central shaft 34*a* of the photosensitive drum 34, and comes in contact with the peripheral surface of the drum 34. The toner supply roller 31 extends to be parallel to the central shaft 34*a* of the photosensitive drum 34, and comes in contact with the peripheral surface of the developing roller 32 at the opposite side to the photosensitive drum 34. Both ends of the central shaft 32*a* of the developing roller 32 and those of the central shaft of the toner supply roller 31 are rotatably supported by the lower end portions of the pair of short opposite walls 19*c* and 19*d* of the developer hopper 19. A toner mixer 29 is provided above the toner supply roller 31 in the containing space. The both end portions of the central shaft of the toner mixer 29 are also rotatably supported by the lower end portions of the short opposite walls 19*c* and 19*d* of the developer hopper 19.

The toner mixer 29 rotates as shown by an arrow D to send toner 28 in the containing space to the toner supply roller 31. The toner supply roller 31 has a peripheral surface formed of sponge. Then, the toner supply roller 31 rotates counterclockwise in FIG. 6 to rub toner 28 which is adhered on the peripheral surface, on a peripheral surface of the developing roller 32. The developing roller 32 rotates counter-clockwise in FIG. 6. A doctor blade 33 is fixed onto an inner surface of one long opposite wall 19*a* located adjacent to the photosensitive drum 34 in the developer hopper 19. A free end of the doctor blade 33 slidably contacts an outer peripheral surface of the developing roller 32 between a position at which the outer peripheral surface reaches the peripheral surface of the photosensitive drum 34 and a position at which the outer peripheral surface reaches the toner supply roller 31. The doctor blade 33 fixes a thickness of a toner layer formed on the peripheral surface of the photosensitive drum 34. Also, the doctor blade 33 generates electric charges in the toner layer by friction to reinforce adhesion of the toner layer to the peripheral surface of the photosensitive drum 34.

As shown in FIG. 6, the photosensitive drum sub-unit 22 comprises a cleaner 36, a charging brush 35, and an elongate hole 39 for an exposure device (not shown) around the photosensitive drum 34. The cleaner 36, the charging brush 35, and the elongate hole 39 are arranged in this order from the tip end portions of support arms 21*b* of the developing sub-unit 21 in a clockwise direction which is a predetermined rotational direction of the photosensitive drum 34. The cleaner 36 has a cleaner blade 36*a* and a waste toner discharging hole 37. The cleaner blade 36*a* contacts the peripheral surface of the photosensitive drum 34 to collect unused toner on the peripheral surface of the photosensitive drum 34 as waste toner. To the waste toner discharging hole 37, the base end portion of the waste toner transfer pipe 23 of FIGS. 5B and 4 is detachably connected.

The photosensitive drum sub-unit 22 further includes a drum cover 38. The drum cover 38 is rotatable between an opening position at which the drum cover 38 exposes a substantially lower half of the peripheral surface of the photosensitive drum 34 to an outer space as shown in FIG. 6, and a closing position at which the drum cover 38 covers the substantially lower half of the peripheral surface of the photosensitive drum 34. The drum cover 38 is arranged at the closing position before the image forming unit 20, which is structured by combining the photosensitive drum sub-unit 22 with the developing sub-unit 21, is attached to a predetermined position of an image forming apparatus (to be described later). And, the drum cover 38 is arranged at the opening position as shown in FIG. 6 when the image forming unit 20 is attached to the predetermined position of the image forming apparatus.

The image forming unit 20 has an input gear train (not shown) and electric terminals (not shown). The input gear train is used for rotating the photosensitive drum 34 of the photosensitive drum sub-unit 22, and the toner mixer 29, the toner supply roller 31, and the developing roller 32 of the developing sub-unit 21, in their predetermined directions. The electric terminals are used for supplying electrical charge to the charging brush 35 of the photosensitive drum sub-unit 22. When the image forming unit 20 is attached to the predetermined position of the image forming apparatus, the input gear train and the electric terminals of the image forming unit 20 are connected to an output gear train of a rotation driving mechanism (not shown) and power supply terminals (not shown), which are provided at predetermined positions of the image forming apparatus.

In this embodiment, since the image forming unit 20 is structured by detachably combined two image forming units such as the developing sub-unit 21 and the photosensitive drum sub-unit 22, each of these two image forming units can be replaced with a new one in consideration of a life time of each image forming unit. Further, these two image forming units can be handled easily like a single image forming unit after they are combined with each other as is shown in FIG. 5A, and they are superior in their operability.

Figure 7:
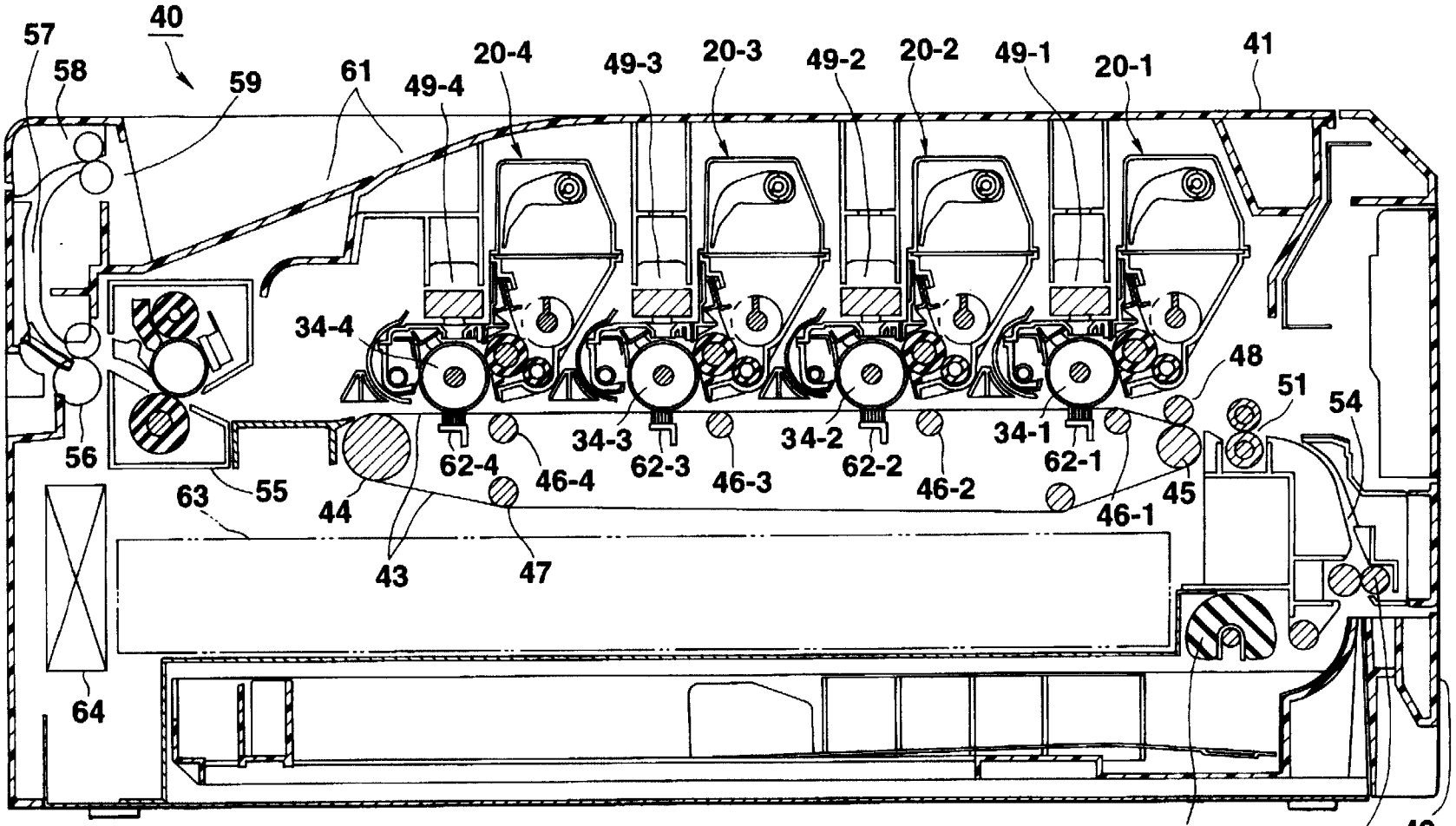
FIG. 7 is a longitudinal cross-sectional view of a tandem type full color printer which is one kind of an image forming apparatus using four image forming units, each image forming unit according to one embodiment of this invention, and combined with the toner collector according to one embodiment of the present invention and described with reference to FIGS. 1 to 6.

FIG. 7 is a longitudinal cross-sectional view of a tandem type full color printer 40 which is one kind of image forming apparatus using four image forming units 20. Each image forming unit 20 according to one embodiment of this invention is combined with the toner collector 10 according to one embodiment of this invention and described with reference to FIGS. 1 to 6.

The tandem type full color printer 40 has an upper cover 41 which is rotatable around a rear end portion (left end portion in FIG. 7) between an opening position and a closing position, on an upper surface of a main housing. A power supply switch (not shown), a liquid crystal display, a plurality of input keys, etc. are arranged on a front end portion (right end portion in FIG. 7) of an upper surface of the cover 41. The tandem type full color printer 40 also has a paper cassette 42 which is detachably arranged in a lower portion of the main housing. In an inner space of the main housing, a transfer belt 43 is arranged between the upper cover 41 and the paper cassette 42 and extends substantially horizontally. The transfer belt 43 is stretched in a loop shape between a drive roller 44 and a follower roller 45 arranged at two positions which are spaced from each other in a horizontal direction with a predetermined length therebetween, and these rollers 44 and 45 extend in parallel to each other. The transfer belt 43 is circulated counter-clockwise by the drive roller 44 in FIG. 7.

A large number of auxiliary rollers 46-1, 46-2, 46-3 and 46-4 come in contact with a back surface (lower surface in FIG. 7) of an upper extending portion of the transfer belt 43. These auxiliary rollers 46-1, 46-2, 46-3 and 46-4 prevent the upper extending portion of the transfer belt 43 from hanging down between the drive and follower rollers 44 and 45. A plurality of tension rollers 47 comes in contact with a back surface (upper surface in FIG. 7) of a lower extending portion of the transfer belt 43. The tension rollers 47 urge the lower extending portion downward by urging means (not shown), so that tension is loaded on the transfer belt 43 between the drive roller 44 and the follow roller 45.

A paper attracting roller 48 comes in contact with the upper extending portion of the transfer belt 43 at a position corresponding to the follow roller 45. The paper attracting roller 48 cooperates with the follow roller 45 to form a paper introducing portion.

A paper introduction path 54 is set between the paper introducing portion and a front end portion (right end portion in FIG. 7) of the paper cassette 42 positioned under the paper introducing portion. A pickup roller 52 is arranged just above the front end portion of the paper cassette 42. The pickup roller 52 sends an uppermost paper in a bundle of papers in the paper cassette 42 to an entrance of the paper introduction path 54. A pair of paper supplying rollers 53 are provided at the entrance, and the paper supplying rollers 53 supply the paper sent to the entrance, to the paper introducing portion. A pair of standby rollers 51 are provided at an exit of the paper introduction path 54. The standby rollers 51 are used to correct a skew of the paper reached the exist, and to send the paper to the paper introducing portion at a predetermined timing for a desirable printing.

The paper attracting roller 48 of the paper introducing portion applies attracting bias on the paper sent from the standby rollers 51, and cooperates with the follow roller 45 to adhere the paper onto an upper surface of the upper extending portion of the transfer belt 43.

Four image forming units 20-1, 20-2, 20-3 and 20-4 are detachably attached to four predetermined positions which are spaced from each other along the upper surface of the upper extending portion of the transfer belt 43. Lower ends of peripheral surfaces of photosensitive drums 34-1, 34-2, 34-3 and 34-4 of the image forming units 20-1, 20-2, 20-3 and 20-4 are close to or in contact with the upper surface of the upper extending portion of the transfer belt 43.

Transfer brushes 62-1, 62-2, 62-3 and 62-4 are arranged along the back surface of the upper extending portion of the transfer belt 43 to contact the back surface at four positions which corresponds to the above-mentioned four predetermined positions, thereby forming a transfer portions.

Four exposure devices 49-1, 49-2, 49-3 and 49-4 are attached to the back surface of the upper cover 41 of the tandem type full color printer 40. The exposure devices 49-1, 49-2, 49-3 and 49-4 are inserted to the elongate holes 39 of the four photosensitive drum sub-units 22 (FIG. 6) of the four image forming units 20-1, 20-2, 20-3 and 20-4 while the upper cover 41 is arranged at the closing position as shown in FIG. 7. The exposure devices 49-1, 49-2, 49-3 and 49-4 expose outer peripheral surfaces of the photosensitive drums 34-1, 34-2, 34-2, 34-3 and 34-4 of the image forming units 20-1, 20-2, 20-3 and 20-4 based on printing data input to the tandem type full color printer 40 corresponding to images to be formed by the image forming units 20-1, 20-2, 20-3 and 20-4.

In the tandem type full color printer 40, four image forming units 20-1, 20-2, 20-3 and 20-4 are used to form black, yellow, magenta, and cyan images in this order. Therefore, in the developer hoppers 19 of the developing sub-units 21 (FIG. 6) of the four image forming units 20-1, 20-2, 20-3 and 20-4, black, yellow, magenta, and cyan toner 28 (FIG. 6) are contained in this order. In this case, yellow, magenta, and cyan toner are subtractive three primaries for a subtractive color mixture.

A fixing unit 55 is arranged in a rear side of the driving roller 44 (left side in FIG. 7) at the level of the upper extending portion of the transfer belt 43. The fixing unit 55 has the well-known structure having a pressing roller, a heating roller, a roller peripheral surface cleaner, an oil applying roller, a thermistor, etc. In the upper extending portion of the transfer belt 43, a toner image is transferred onto the paper from the outer peripheral surface of each of the photosensitive drums 34-1, 34-2, 34-3 and 34-4 of the four image forming units 20-1, 20-2, 20-3 and 20-4 by the transfer brushes 62-1, 62-2, 62-3 and 62-4 of the transfer portions. The transferred toner images are fixed onto the paper through pressing and heating by means of the pressing roller and the heating roller of the fixing unit 55.

Moreover, in the main housing of the tandem type full color printer 40, a paper discharging path 57 is provided at the rear side (left side in FIG. 7) of the fixing unit 55. The paper discharging path 57 extends from the rear side of the fixing unit 55 to a discharge tray 61 formed at a rear end portion (left end portion of FIG. 7) of the upper surface of the upper cover 41. At an entrance of the paper discharging path 57, a pair of paper discharging rollers 56 are arranged to introduce an image-formed paper discharged from the fixing unit 55 to the paper discharging path 57. At an exit 59 of the paper discharging path 57, a pair of exit rollers 58 are arranged to discharge the image-formed paper from the paper discharging path 57 to the discharge tray 61 at the rear end portion of the upper surface of the upper cover 41.

Moreover, in the main housing of the tandem type full color printer 40, an electrical component section 63 which includes a plurality of circuit boards for controlling the function of the full color printer 40, is arranged between the lower extending portion of the transfer belt 43 and the paper cassette 42. At a rear side of the electrical component section 63 (left portion in FIG. 7), an exhaust fan 64 is arranged. The exhaust fan 64 exhausts heat which is generated by the electrical component section 63 and the fixing device 55, to the outer side of the main housing.

The structure of the above-mentioned tandem type full color printer 40 is well known, and the operation is also well known. Therefore, an explanation of its operation will be omitted.

Waste toner collected in the cleaner 36 of the photosensitive drum sub-unit 22 (FIG. 6) of each of four image forming units 20-1, 20-2, 20-3 and 20-4 in the above-mentioned tandem type full color printer 40 is transferred through the waste toner pipe 23 (FIGS. 4 and 5B) by the waste toner transfer screw 15 from the waste toner discharge hole 37 of the cleaner 36 to the upper end portion of the containing space of the developer hopper 19 of the developing sub-unit 21 (FIG. 6) of each of the four image forming units 20-1, 20-2, 20-3 and 20-4. Then, the waste toner is collected in the waste toner collecting bag 12 through the cylindrical tube 11 of the toner collector 10 (FIG. 1) according to one embodiment of the present invention. The waste toner collected in the toner collecting bag 12 is indicated by reference numeral 16 in FIGS. 4 and 6.

In the toner collector 10 (FIG. 1) according to the above mentioned one embodiment of the present invention, the waste toner collecting bag 12 is expanded under the both end portions 11*d* of the cylindrical tube 11 to be used to its maximum capacity. Such expanded waste toner containing bag 12 can contain more waste toner 16 than a waste toner collecting bag not expanded under the both end portions 11*d* of the cylindrical tube 11. Moreover, in the upper portion of the toner containing space of the developer hopper 19 of the developing sub-unit 21 of the image forming unit 20, it is possible to reduce a volume (particularly, in up and down directions) required to contain the waste toner collecting bag 12. As a result, the height of the developer hopper 19 of the developing sub-unit 21 can be reduced. Moreover, it is possible to reduce the height of the image forming apparatus such as the tandem type full color printer 40, using the image forming unit 20 (FIG. 6) which is combined with the toner collector 10 (FIG. 1) according to the above-explained embodiment.

The toner collector 10 having the waste toner collecting bag 12 which is combined with thecylindrical tube 11 can be easily attached to the predetermined position of the upper portion of the toner containing space of the developer hopper 19 of the developing sub-unit 21 of the image forming unit 20. The waste toner 16 collected in the waste toner collecting bag 12 can be effectively prevented from being splashed at the time of disposing of the toner collector 10, disposing of the developing sub-unit 21 with the toner collector 10, and disposing of the image forming unit 20 including the developing sub-unit 21 with the toner collector 10. Then, a recycling of the developing sub-unit 21 and the image forming unit 20 can be easily carried out.

The structure of the waste toner collecting bag 12 is simple, so that the waste toner collecting bag 12 can be formed by only cutting and welding. As a result, the manufacturing cost of the bag 12 is greatly reduced.

The amount of the waste toner 16, the waste toner 16 being collected by the cleaner 36 of the photosensitive sub-unit 22 and being finally collected in the waste toner collecting bag 12, is smaller than that of toner 28, the toner 28 being originally contained in the developer hopper 19. Due to this, when the waste toner collecting bag 12 containing the waste toner 16 hangs from the cylindrical tube 11, the bag 12 will not come in contact with the toner mixer 29 in the containing space of the developer hopper 19, so that the operation of the toner mixer 29, that of the image forming unit 20, and that of the image forming apparatus such as the tandem type full color printer 40 using the image forming units 20 will not be obstructed.

Figure 8A:
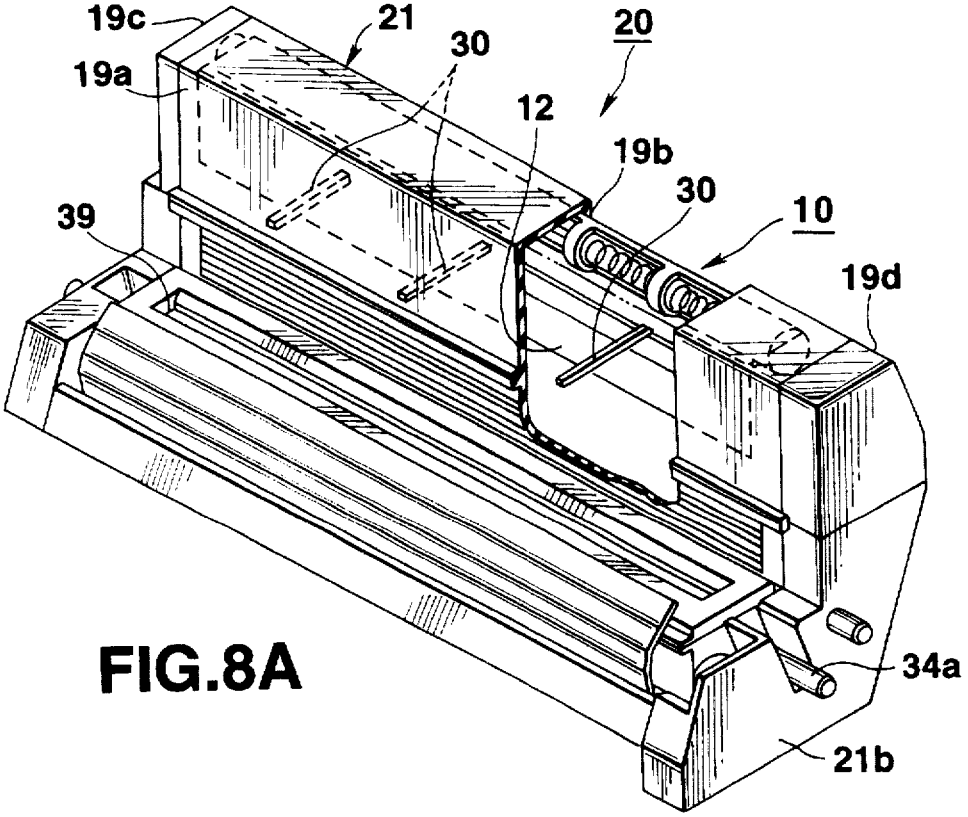
FIG. 8A is a perspective view showing an appearance of a modification of the image forming unit, in which the image forming unit is combined with the toner collector according to one embodiment of this invention and described with reference to FIGS. 1 to 6, and a part of the image forming unit is cut away.
Figure 8B:
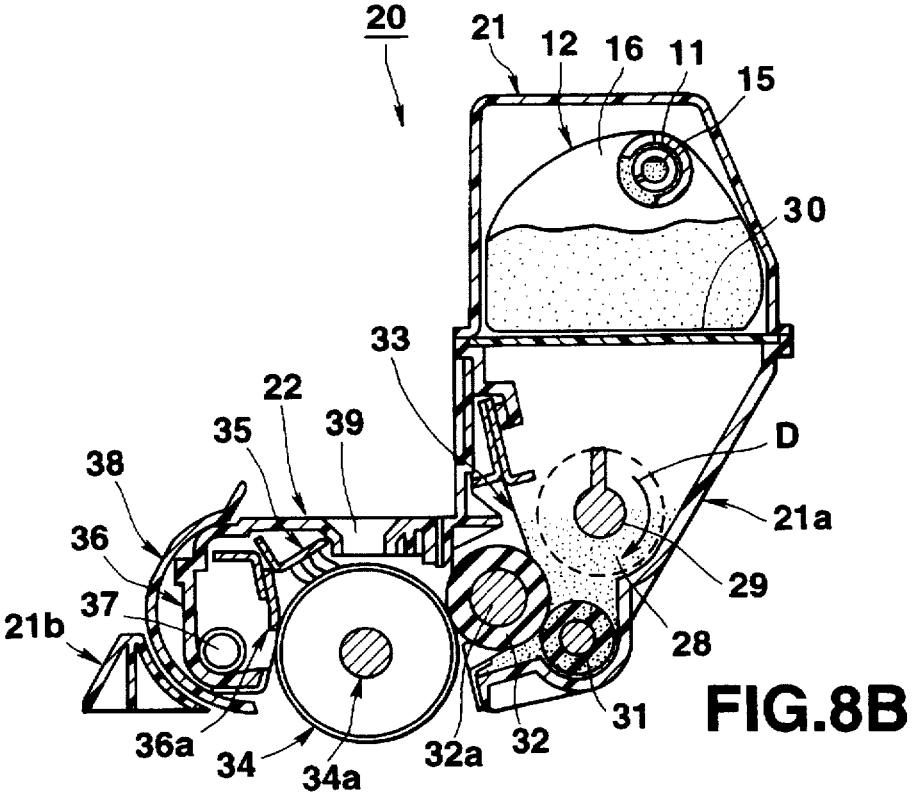
FIG. 8B is a cross-sectional view of the modification of the image forming unit of FIG. 8A.

FIGS. 8A and 8B are a perspective view and a cross-sectional view each showing a modification of the image forming unit 20. This modification largely reduces the height of the developing sub-unit 21, that of the image forming unit 20, and that of the image forming apparatus such as the tandem type full color printer 40 using the image forming unit 20 (FIG. 6) as compared with the developing sub-unit 21 using the toner collector 10 (FIG. 1) according to the above-mentioned embodiment of this invention, and that of the image forming apparatus such as the tandem type full color printer 40 using the image forming unit 20 (FIG. 6).

This modification is different from the developing sub-unit 21 using the toner collector 10 (FIG. 1) according to the above-mentioned embodiment of this invention, and that of the image forming apparatus such as the tandem type full color printer 40 using the image forming unit 20.

Specifically, in the containing space of the developer hopper 19 of the developing sub-unit 21 of this modification, waste toner containing bag support members 30 are provided between the waste toner collecting bag 12 of the toner collector 10 according to the above-mentioned embodiment and the toner mixer 29.

The waste toner containing bag support members 30 can be integrally formed with the developer hopper 19. And at the time when each of the support members 30 is formed to a rod-shape as shown in FIG. 8A, the waste toner containing bag support members 30 can be easily and lightly structured. Further, the waste toner containing bag support members 30 can be formed to have a lattice-shape.

The waste toner collecting bag support members 30 support the waste toner collecting bag 12 when the bag 12 is hung down from the cylindrical tube 11 by the deposition of the waste toner 16, and restrict the amount of hanging of the waste toner collecting bag 12. As a result, even if a height of an area which is used to contain the waste toner collecting bag 12 in the upper end portion of the containing space of the developer hopper 19 of the developing sub-unit 21, is set to be small to reduce the height of the developing sub-unit 21, the waste toner containing bag 12 will not come in contact with the toner mixer 29 when the waste toner 16 is deposited in the bag 12 and the bag 12 is hung down.

Since the waste toner collecting support members 30 increase rigidity of the developing toner containing housing 21*a* of the image forming unit 20, the developing toner containing housing 21*a* can be thinned. This becomes more important as a width of a recording medium such as paper on which an image is formed by the image forming apparatus such as the tandem type full color printer 40 using the image forming unit 20, that is, a length of the recording medium along a longitudinal direction of the photosensitive drum 34 is increased, because the rigidity of the developing toner containing housing 21*a* must be increased as the length of the developing toner containing housing 21*a* is increased, more because the amount of hanging of the waste toner collecting bag 12 is increased as the volume of the waste toner collecting bag 12 is increased.

Figure 9:
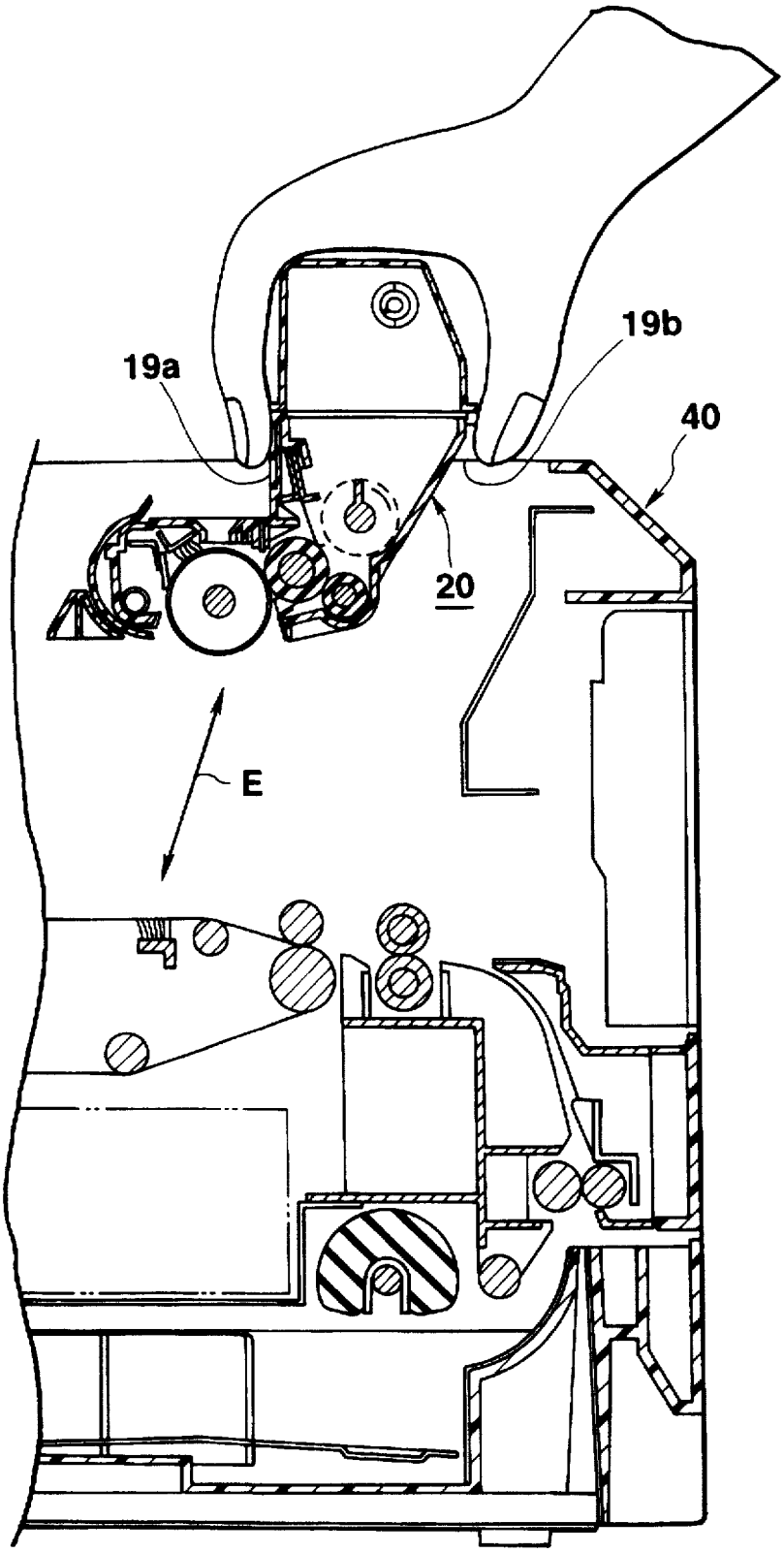
FIG. 9 is an enlarged longitudinal cross-sectional view in which one image forming unit according to one embodiment of this invention and being combined with the toner collector according to one embodiment of this invention and described with reference to FIGS. 1 to 6, is attached to or detached from the tandem type full color printer of FIG. 7.
Figure 10A:
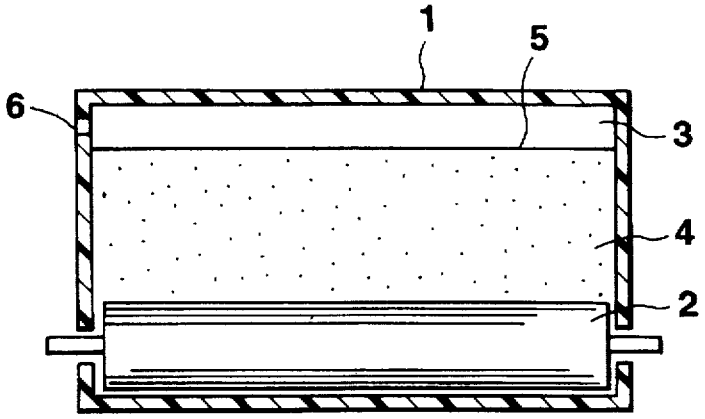
FIG.10A PRIOR ART
FIG. 10A is a longitudinal cross-sectional view showing a conventional toner collector before waste toner is collected.
Figure 10B:
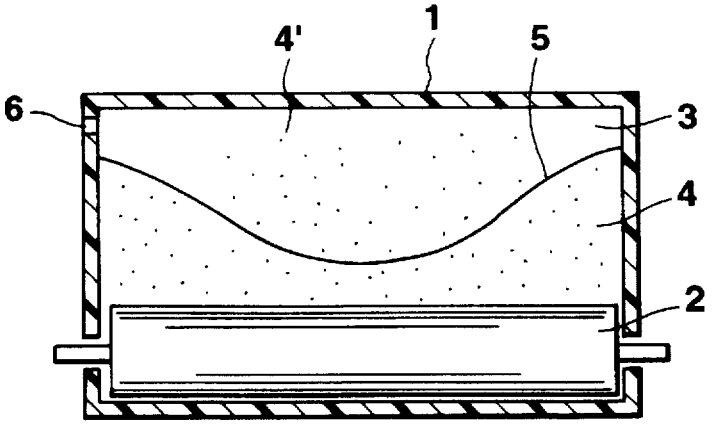
FIG.10B PRIOR ART
FIG. 10B is a longitudinal cross-sectional view showing the conventional toner collector of FIG. 10A after waste toner is collected.
Figure 11:
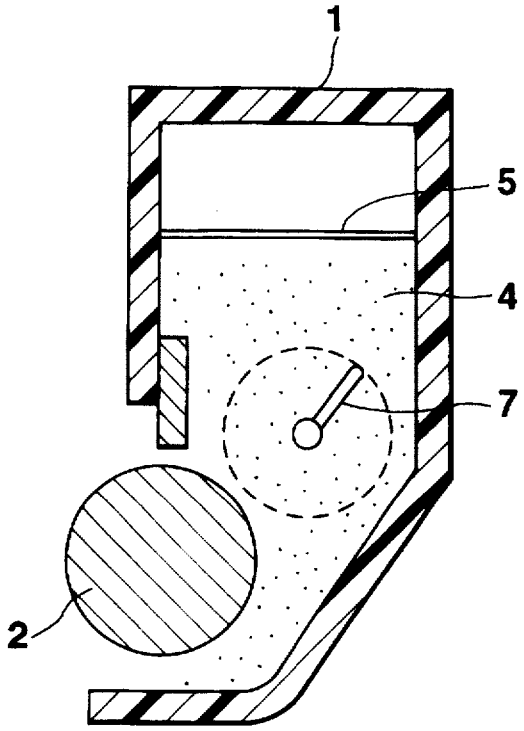
FIG.11 PRIOR ART
FIG. 11 is a cross-sectional view showing a conventional toner collector which is different from the conventional toner collector of FIGS. 10A and 10B, before waste toner is collected.

FIG. 9 shows a state in which the image forming unit 20 is attached to or detached from a predetermined position in the main housing of the tandem type full color printer 40 as shown by a bidirectional arrow E with a user's hand while the upper cover 41 is opened in the tandem type full color printer 40 of FIG. 7. FIG. 9 further shows that the user's hand grasps the long side opposite walls 19*a* and 19*b* of the developing toner containing housing 21*a* (FIG. 6) of the image forming unit 20 during the attachment or detachment of the image forming unit 20. In order to resist against gravity and clamping force applied by the user's hand, the rigidity of the developing toner containing housing 21*a* of the image forming unit 20 is important.

In the above embodiment and the modification, the material of the waste toner collecting bag 12 was soft synthetic resin such as polyethylene. However, the material may be paper if it does not allow toner to pass therethrough and is soft. Then, a desired sealing of a paper-made waste toner collecting bag 12 can be achieved by adhering means such as paste, double coated adhesive tape, etc.

Further, in the above mentioned embodiment and the modification, the large image forming unit 20 is configured by combining the two small image forming units. That is, the developing sub-unit 21 and the photosensitive drum sub-unit 22 are combined with each other in the outside of the tandem type full color printer 40, and then the large image forming unit 20 is attached to or detached from the predetermined position of the printer 40. These two small image forming units can be attached to or detached from the predetermined position of the printer, individually.

Still further, this invention can be applied to a single image forming unit structured by integrally combining the photosensitive drum 34, the cleaner 36, the charge brush 35, the developing toner containing housing 21*a*, etc. with each other.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

We claim:

1. A toner collector comprising:

a tube having at least one opening in an intermediate portion between both end portions thereof, one of the both end portions being closed;

a toner collecting bag covering the tube, and connected to the tube at the both end portions of the tube; and a waste toner transfer member, connected to the other of the both end portions of the tube, for transferring toner to the other of the both end portions from an outer side of the tube.

2. A toner collector according to claim 1, wherein said toner collector is combinable with an image forming apparatus having an image carrier on which an image developed by toner is formed, and the toner collected into the toner collecting bag is waste toner removed from the image carrier.

3. A toner collector according to claim 1, wherein the toner collecting bag is shaped substantially like a T-shirt having two sleeve portions and whose neck and hem portions are closed, the tube is inserted into the toner collecting bag through openings of a pair of portions of the toner collecting bag corresponding to both sleeve portions of the T-shirt, and the paired portions of the toner collecting bag are closely fixed to both end portions of the tube.

4. A toner collector according to claim 3, wherein an outer peripheral surface of each of the both end portions of the tube has a rugged portion, and the toner collecting bag has a pair of winding portions at the paired portions of the toner collecting bag corresponding to the both sleeve portions of the T-shirt, the paired portions of the bag being closely fixed to the rugged portions of the both end portions of the tube.

5. A toner collector according to claim 1, wherein the toner collecting bag is formed of synthetic resin.

6. A toner collector according to claim 1, wherein a length of the toner collecting bag along a longitudinal direction of the tube is longer than a distance between the both end portions of the tube, and the toner collecting bag is compressed in a direction along the longitudinal direction and then connected to the both end portions of the tube.

7. A toner collector according to claim 1, wherein the waste toner transfer member includes a toner transfer pipe extending from the outer side of the tube to the other of the both end portions of the tube and connected to the other of the both end portions of the tube, and a transfer screw extending from an interior of the toner transfer pipe to an interior of the tube and rotated in the interior of the toner transfer pipe and the interior of the tube.

8. An image forming unit, which is combinable with an image carrier on which an image to be developed by toner is formed, and a cleaner for removing unnecessary toner from the image carrier to achieve an image forming apparatus for developing the image on the image carrier with toner, said image forming unit comprising:

a developing unit for developing the image on the image carrier by toner;

a toner hopper, having a toner containing space, for supplying toner to the developing unit;

a tube provided in the toner containing space of the toner hopper, said tube having at least one opening in an intermediate area between both end portions thereof, one of the both end portions being closed;

a toner collecting bag covering the tube and connected to the tube at the both end portions of the tube; and a waste toner transfer member, connected to the other of the both end portions, for transferring unnecessary toner to the other of the both end portions of the tube from the cleaner.

9. An image forming unit according to claim 8, wherein the toner collecting bag is shaped substantially like a T-shirt having two sleeve portions and whose neck and hem portions are closed, the tube is inserted into the toner collecting bag through openings of a pair of portions of the toner collecting bag corresponding to both sleeve portions of the T-shirt, and the paired portions of the toner collecting bag are closely fixed to both end portions of the tube.

10. An image forming unit according to claim 9, wherein an outer peripheral surface of each of the both end portions of the tube has a rugged portion, and the toner collecting bag has a pair of winding portions at the paired portions of the toner collecting bag corresponding to the both sleeve portions of the T-shirt, the paired portions of the bag being closely fixed to the rugged portions of the both end portions of the tube.

11. An image forming unit according to claim 8, wherein the toner collecting bag is formed of synthetic resin.

12. An image forming unit according to claim 8, wherein a length of the toner collecting bag along a longitudinal direction of the tube is longer than a distance between the both end portions of the tube, and the toner collecting bag is compressed in a direction along the longitudinal direction and then connected to the both end portions of the tube.

13. An image forming unit according to claim 8, wherein the waste toner transfer member includes a toner transfer pipe extending from an outer side of the tube to the other of the both end portions of the tube and connected to the other of the both end portions, and a transfer screw extending from an interior of the toner transfer pipe to an interior of the tube and rotated in the interior of the toner transfer pipe and the interior of the tube.

14. An image forming unit according to claim 8, wherein the toner hopper includes a pair of long opposite wall portions, a pair of short opposite wall portions, and a toner collecting bag support member;

the long opposite wall portions extending in parallel to each other and being spaced from each other in a direction perpendicular to the extending direction of the long opposite wall portions;

the short opposite wall portions being connected to both ends of the long opposite wall portions and being spaced from each other in the extending direction, and defining the toner containing space in cooperation with the long opposite wall portions; and the toner collecting bag support member being connected to the long opposite wall portions under the tube and the toner collecting bag, and supporting the hanging of the toner collecting bag produced by the weight of the collected toner so as to define an amount of the hanging.

15. An image forming unit according to claim 14, wherein the toner hopper includes a toner mixing member under the toner collecting bag support member in the toner containing space.

16. An image forming unit according to claim 14, wherein the toner collecting bag support member comprises a reinforcing member for the toner hopper.

* * * * *

UNITED STATES PATENT AND TRADEMARK OFFICE

CERTIFICATE OF CORRECTION

PATENT NO. : 5,781,841
DATED : July 14, 1998
INVENTOR(S) : KOUROKU et al.

It is certified that error appears in the above-identified patent and that said Letters Patent is hereby corrected as shown below:

On the title page, Item [30],
under "Foreign Application Priority Data",
"Apr. 11, 1996" should be --Apr. 15, 1996--.

Signed and Sealed this
Thirteenth Day of July, 1999

*Attest:*

*Attesting Officer*

Q. TODD DICKINSON

*Acting Commissioner of Patents and Trademarks*